United States Patent [19]

Iida et al.

[11] Patent Number: 4,917,364

[45] Date of Patent: Apr. 17, 1990

[54] SHEET PROCESSING APPARATUS

[75] Inventors: Noriyoshi Iida, Ichikawa; Nobutaka Uto, Yokohama; Masakazu Hiroi, Tokyo; Akimitsu Hoshi, Yokohama, all of Japan

[73] Assignee: Canon Kabushiki Kaisha, Tokyo, Japan

[21] Appl. No.: 258,128

[22] Filed: Oct. 13, 1988

Related U.S. Application Data

[63] Continuation of Ser. No. 839,607, Mar. 14, 1986, abandoned.

[30] Foreign Application Priority Data

Mar. 15, 1985 [JP] Japan ..... 60-052055
Apr. 19, 1985 [JP] Japan ..... 60-085088

[51] Int. Cl.[4] ..... B41L 43/12

[52] U.S. Cl. ..... 270/37; 270/53; 227/99; 493/416; 355/322; 355/324

[58] Field of Search ..... 270/37–38, 270/53, 58; 353/145 H; 493/419, 421, 423, 416, 417, 322, 324; 412/6, 33; 227/99, 100, 101

[56] References Cited

U.S. PATENT DOCUMENTS

| | | | |
|---|---|---|---|
| 1,269,039 | 6/1918 | Barber | 270/37 |
| 3,294,394 | 12/1966 | Holms et al. | 270/37 |
| 3,411,686 | 11/1968 | Bender | 226/185 |
| 3,554,531 | 1/1971 | Heigl | 270/37 |
| 3,704,793 | 12/1972 | Nicol et al. | 271/86 |
| 3,709,595 | 1/1973 | Turner et al. | 355/324 |
| 3,847,388 | 11/1974 | Lynch | 271/174 |
| 3,907,276 | 9/1975 | Gerbasi | 271/80 |
| 3,968,364 | 7/1976 | Miller | 271/215 |
| 4,194,832 | 3/1980 | Tabayashi | 355/324 |
| 4,229,650 | 10/1980 | Takahashi et al. | 271/215 X |
| 4,248,413 | 2/1981 | Fox | 270/53 |
| 4,285,511 | 8/1981 | Abe | 271/178 |
| 4,313,670 | 2/1982 | Caldwell | 355/324 |
| 4,334,759 | 6/1982 | Clausing | 271/228 X |
| 4,424,963 | 1/1984 | Bartholet et al. | 270/53 |
| 4,552,497 | 11/1985 | Kockler et al. | 270/37 |
| 4,561,765 | 12/1985 | Masuda | 355/14 SH |
| 4,566,782 | 1/1986 | Britt et al. | 270/53 |
| 4,568,172 | 2/1986 | Acquaviva | 355/324 |
| 4,569,514 | 2/1986 | Holtje | 271/314 |
| 4,602,776 | 7/1986 | York et al. | 355/14 SH |
| 4,603,971 | 8/1986 | Kukucka et al. | 355/324 |
| 4,626,156 | 12/1986 | Baughman et al. | 270/58 |

FOREIGN PATENT DOCUMENTS

| | | | |
|---|---|---|---|
| 1243966 | 7/1967 | Fed. Rep. of Germany | 271/182 |
| 0077158 | 5/1982 | Japan | 271/176 |
| 0052140 | 3/1983 | Japan | 271/182 |
| 0031463 | 2/1985 | Japan | 271/182 |
| 2069981 | 9/1981 | United Kingdom | 493/423 |
| 290590 | 12/1982 | United Kingdom | 493/421 |

*Primary Examiner*—Eugene H. Eickholt
*Attorney, Agent, or Firm*—Fitzpatrick, Cella, Harper & Scinto

[57] ABSTRACT

A sheet post-processing apparatus. It includes a first post-processing device for effecting a processing to the sheet material and a second post-processing device for effecting to the sheet a processing different from the aformationed processing. The apparatus is capable of selectively discharging or processing the sheet material discharged from the image forming apparatus.

36 Claims, 10 Drawing Sheets

SHEET PROCESSING APPARATUS

This application is a continuation of application Ser. No. 839,607, filed Mar. 14, 1986, now abandoned.

FIELD OF THE INVENTION AND RELATED ART

The present invention relates to a sheet handling or sheet post-processing apparatus, which will hereinafter be called simply "sheet processing apparatus", for processing sheet materials discharged from an image forming apparatus such as a copying machine and printer.

Conventionally, as an example of such a sheet processing apparatus, a sheet folding apparatus, a sheet stacking apparatus and a sheet stapling apparatus are independently and separately constructed, and they are selectively coupled to the image forming apparatus. Therefore, it has been necessary that those apparatuses are interchanged as desired, which has been very inconvenient.

SUMMARY OF THE INVENTION

Accordingly it is a principal object of the present invention to provide a sheet processing apparatus wherein a desired processing can be performed to the sheet materials without interchanging the sheet processing apparatuses.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
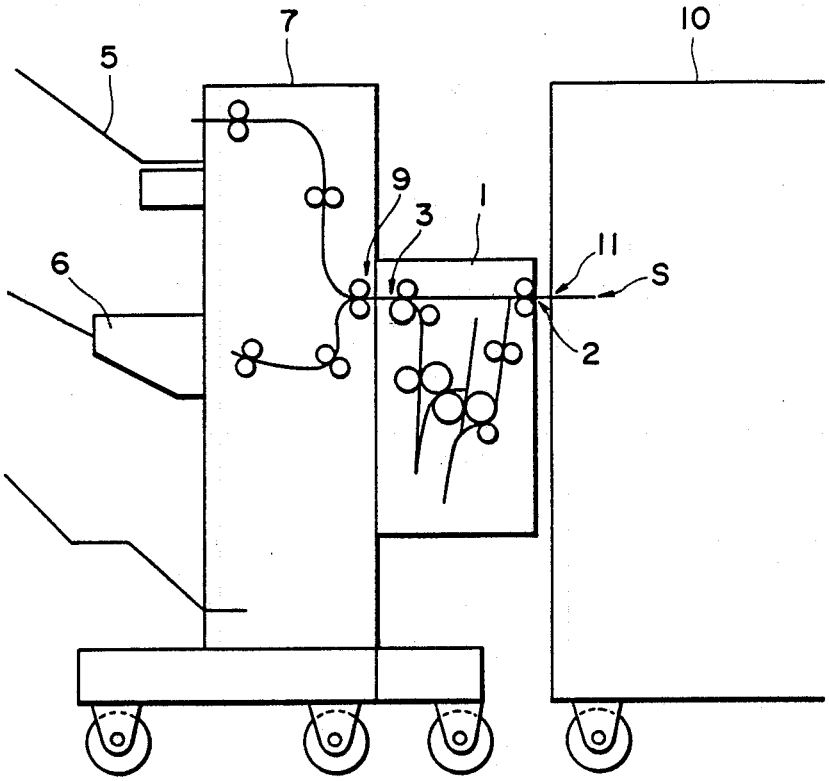
FIG. 1 is a sectional view of a sheet folding apparatus according to an embodiment of the present invention, which is used with an image forming apparatus together with a finisher apparatus.

Referring to FIG. 1, there is shown a sheet folding apparatus according to an embodiment of the present invention, which is coupled to a copying apparatus 10 together with a finisher apparatus 7. A sheet discharging outlet 3 of the sheet folding apparatus 1 is aligned with the sheet receiving inlet 9 of the finisher apparatus 7, while the sheet discharging outlet 11 of the copying apparatus 10 is aligned with the sheet receiving inlet 2 of the folding apparatus 1.

Figure 2:
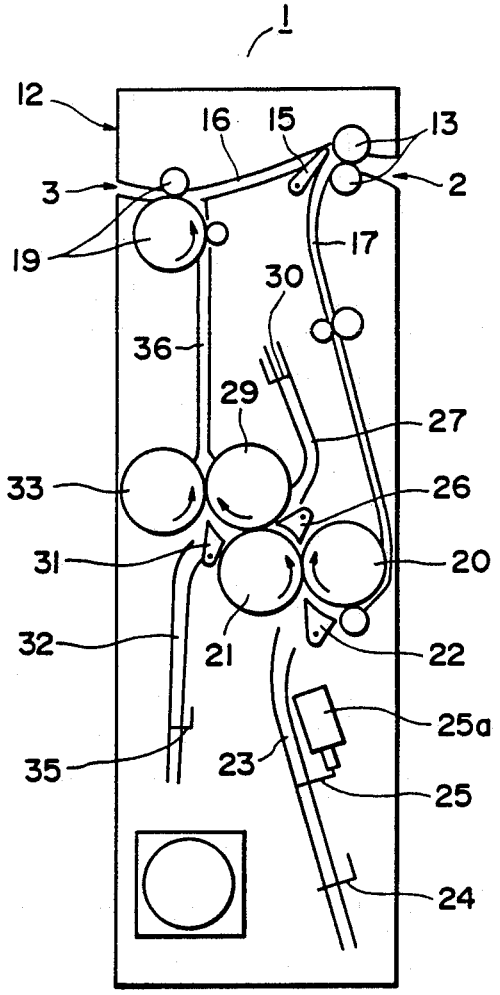
FIG. 2 is a sectional view of a sheet folding apparatus according to the embodiment of the present invention.

As shown in FIG. 2, the sheet receiving inlet 2 of the sheet folding apparatus 1 is disposed at an upper portion of the frame 12 of the sheet folding apparatus. At the inlet 2, there is provided a receiving couple of rollers 13 and 13. At a downstream portion of the receiving couple of rollers 13 and 13 with respect to the direction of transportation of the sheet, there is an inlet deflector 15 to switch the transportation of the sheet in two directions, more particularly, selectively to a sheet passing passage 16 or to a sheet folding passage 17. At a position downstream of the sheet passing passage 16, there is a discharging couple of rollers 19 and 19, which is effective to discharge the sheet S through the downstream discharging outlet 3. The sheet discharging outlet 3 is at substantially the same level of the sheet receiving inlet 2.

A first folding roller 21 is disposed downstream of the folding passage 17. Contacted to the first folding roller 20 is a second folding roller 21. Those rollers are rotatable in the direction indicated by arrows. Downstream cf the first folding roller 20, a first deflector 22 is provided in order to switch the sheet passage, whereby the sheet S received from the folding passage 17 is selectively conveyed to a first folding position controlling passage 23 or two a first stage folding roller couple (20, 21) constituted by the first and second folding rollers 20 and 21.

Downstream of the first folding position controlling passage 23, there are disposed a fixed stopper 24 and a movable stopper 25 which is driven by a solenoid **25*a* in the manner that the movable stopper 25 goes into the passage 23 when the solenoid 25*a* is energized. A second deflector 26 is disposed downstream of the first stage folding roller couple (20, 21) and is effective to switch the sheet transportation. More particularly, it can direct the sheet S conveyed from the first stage folding roller couple (20, 21) selectively to a second folding position controlling passage 27 or to a second stage folding roller couple (21, 29) constituted by the second folding roller 21 and a third folding roller 29 contacted to the roller 21. And, downstream of the second folding position controlling passage 27, a fixed stopper 30** is provided.

A third deflector 31 is disposed downstream of the second stage folding roller couple (21, 29). The third deflector 31 is effective to direct the sheet S in two directions selectively. More particularly, it allows the sheet S conveyed from the second stage folding roller couple (21, 29) to pass to a third folding position controlling passage 32 or to a third stage folding roller couple (29, 33) constituted by the third folding roller 29 and a fourth folding roller 33 contacted to the roller 29. And, downstream of the third folding position controlling passage 32, a fixed stopper 35 is mounted. Furthermore, downstream of the third stage folding roller couple (29, 33), there is an additional passage 36 for the sheet which finishes the folding operations. The downstream end of the passage 36 is opened to the discharging roller couple 19 and merges with the above-described sheet passing passage 16.

Figure 4:
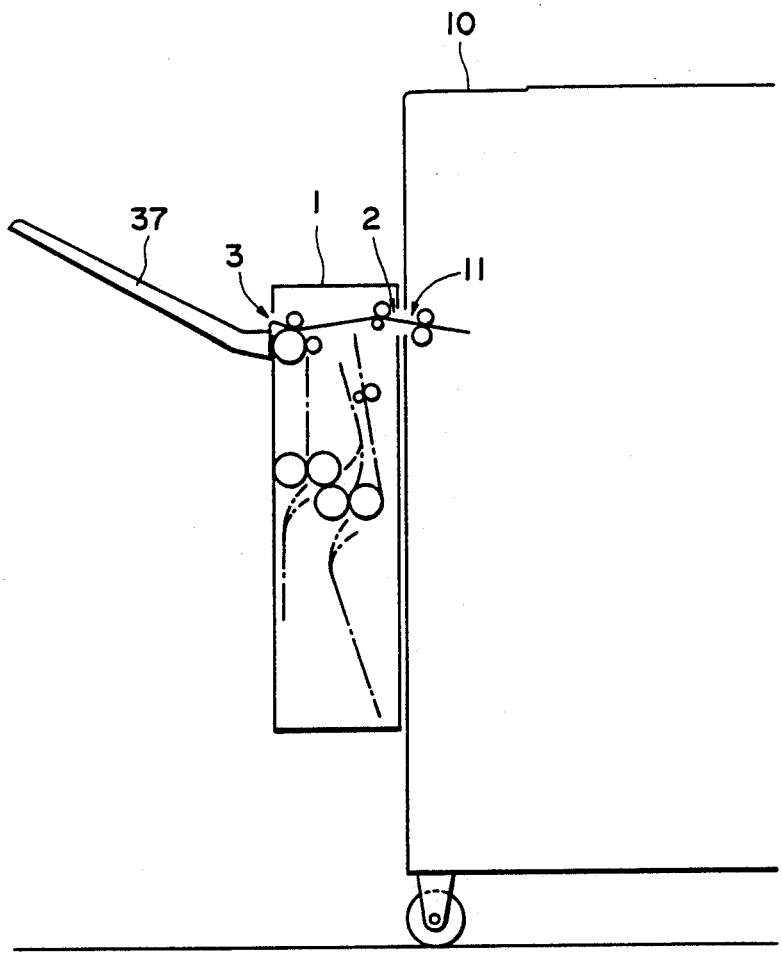
FIG. 4 is a sectional view of the sheet folding apparatus which alone is coupled to the image forming apparatus.

As shown in FIG. 4, a bin tray 37 can be detachably mounted to the sheet discharging outlet 3 of the sheet folding apparatus, and the sheet folding apparatus can be detachably attached to the copying apparatus 10 in the manner that the sheet receiving inlet 2 of the sheet folding apparatus 1 is aligned with the sheet discharging outlet 11 of the copying machine 10.

Figure 6:
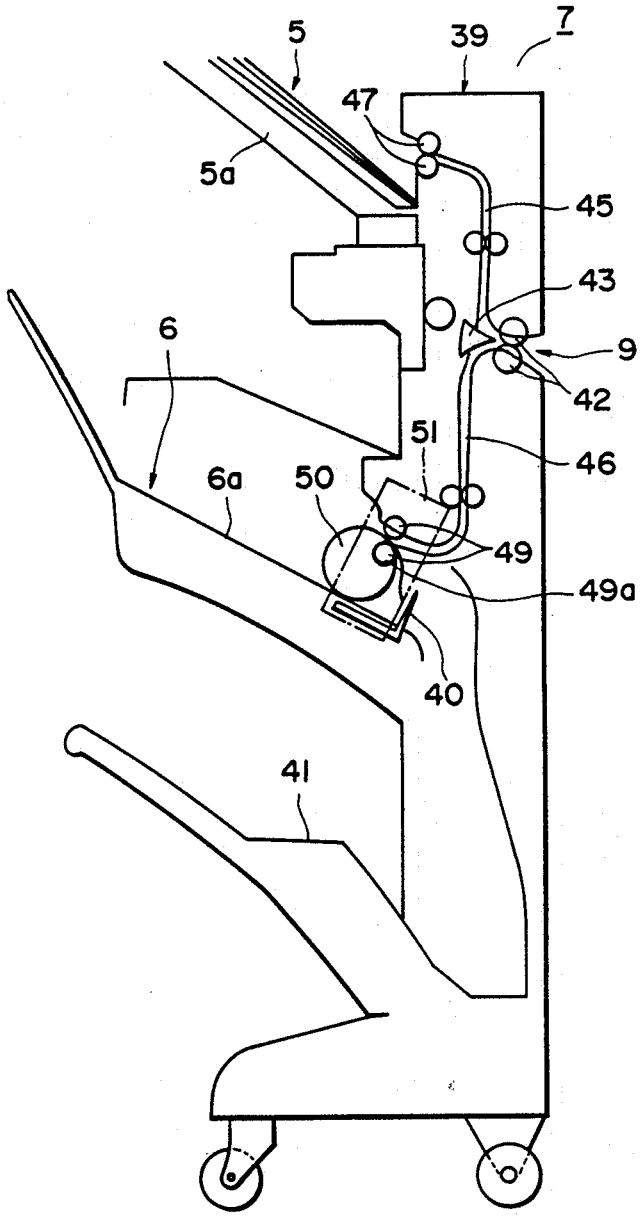
FIG. 6 illustrates an example of a finisher apparatus according to an embodiment of the present invention.

As shown in FIG. 6, to the finisher apparatus 7, a sheet stacking tray 5*a* can be attached at a rear upper portion of the frame 37 of the apparatus. The sheet stacking tray 5*a* constitutes a stacker portion 5 reciprocable in horizontal and vertical directions. In the main frame 39 of the apparatus there is an intermediate tray 6*a* below the stacker portion 5, the intermediate tray 6*a* constituting a stapling portion 6. At a front end of the intermediate tray 6*a*, there is disposed a rotatable stopper 40 for supporting an edge of the sheet S on the tray 6*a*. Below the stapling portion 6 of the main frame 39, there is a lower tray 41 so that the sheet S which falls from the intermediate tray 6*a* when the stopper 40 pivots, is received on the lower tray 41. A sheet receiving inlet 9 is disposed in the front upper portion of the main frame 39 of the finisher apparatus at such a level which is substantially the same as the sheet discharging outlet of the copying apparatus 10. At the sheet inlet 9, a couple of receiving rollers 42 and 42 is disposed. Downstream of the roller couple 42, there is an inlet deflector 43 so as to selectively direct the sheet from the sheet inlet 9 to a passage 45 leading to the stacker portion or to a passage 46 leading to the stapling portion. At the downstream end of the stacker passage 45, a discharging roller couple 47 is provided so as to discharge the sheet S to the sheet stacking tray 5*a*. At the downstream end of the stapling portion passage 46, there is a discharging couple of rollers 49 and 49. Around a lower roller 49*a* of the discharging couple 49 of rollers, a part of a belt 50 in contact with the intermediate tray 6*a* is trained, so that the belt 50 rotates together with the lower roller 49*a*, and the sheet S discharged onto the intermediate tray 6*a* is aligned along the stopper 40 at the edge thereof by the rotation of the discharging roller couple 49. Further, a stapler 51 is disposed above the lower part of the intermediate tray 6*a* and is effective to staple the sheets S on the intermediate tray 6*a*.

Figure 7:
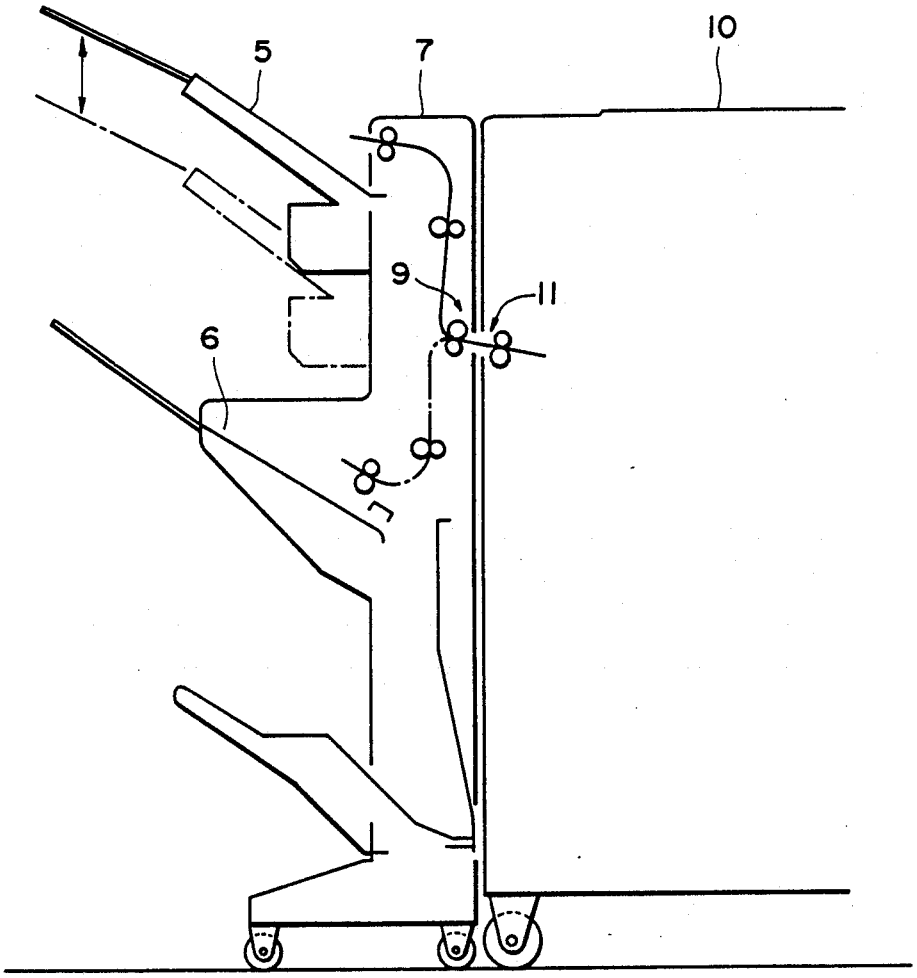
FIG. 7 is a sectional view of the finisher apparatus which alone is coupled to the image forming apparatus.

As shown in FIG. 7, the finisher apparatus 7 can be directly coupled to the copying apparatus 10 in the manner that the sheet receiving inlet 9 of the apparatus 7 is aligned with the sheet discharging outlet 11 of the copying apparatus.

Figure 8:
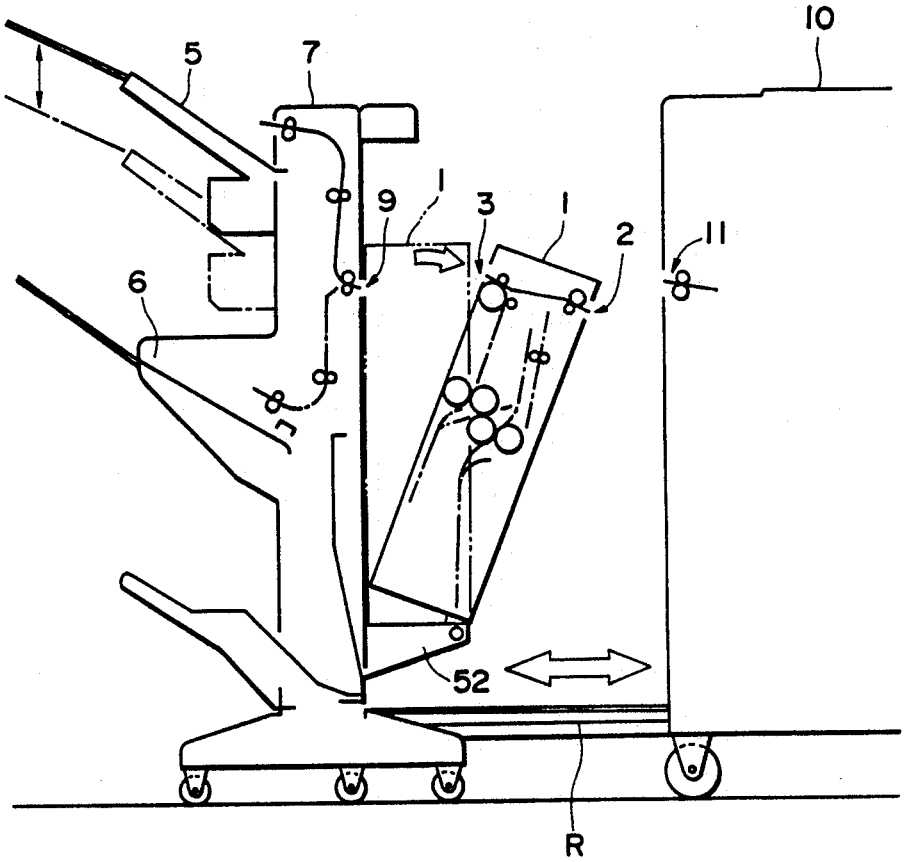
FIG. 8 is a sectional view of the sheet folding apparatus, the finisher apparatus and the image forming apparatus and illustrated the way of coupling them.

As shown in FIG. 8, when the folding apparatus 1 is coupled with the finisher apparatus 7, the lower side portions of the folding apparatus 1 is rotatably coupled to the leading portions of the bracket 52 mounted at the lower portion of the finisher apparatus, so that the folding apparatus 1 can be opened about the rotatably coupled pivot to dispose of a jam, when it occurs.

Since the folding apparatus according to this embodiment is of the structure as described above, when the folding apparatus 1 is connected to the copying machine 10, while the finisher apparatus 7 is connected to the folding apparatus, the folding apparatus 1 is rotatably supported on the finisher apparatus 7, and the finisher apparatus 7 is disposed in series with the copying apparatus 10 along a rail R so that the discharging outlet 11 of the copying apparatus 10 is aligned with the sheet receiving inlet 2 of the folding apparatus 1, as shown in FIG. 8.

The folded sheet S discharged through the discharging outlet 11 of the copying apparatus 10 is conveyed from the inlet 2 to the inlet deflector 15 by the rotation of the receiving couple of rollers 13 and 13. When a through-pass mode is selected wherein the sheet S is not subjected to any folding operation, the inlet deflector 15 selects the passing passage 16 so that the sheet S is transported through the passage 16 and is discharged to the discharge outlet 3 by the discharging roller couple 19.

As shown in FIG. 5, when a two-folding mode, z-folding mode or a reversed z-folding mode is selected, the inlet deflector 15 selects the passage 17, so that the sheet S is directed to the passage 17. The sheet S is conveyed through the passage 17 and is conveyed to a first deflector 12 by the rotation of the first folding roller 20. When a half size sheet (smaller than A4 or B5 (Japanese Industrial Standard)) is conveyed in the sheet folding mode, the first deflector 22 selects the first stage folding roller couple (20, 21); the second deflector 26 selects the second stage folding roller couple (21, 29); and the third deflector 31 selects the third stage folding roller couple (29, 33). Then, the sheet S passes through the first stage folding roller couple (20, 21), the second stage folding roller couple (21, 29) and the third stage folding roller couple (29, 33) and through the additional passage 36, and finally is discharged through the sheet discharging outlet 3 by the rotation of the discharging roller couple 19.

Figure 3A:
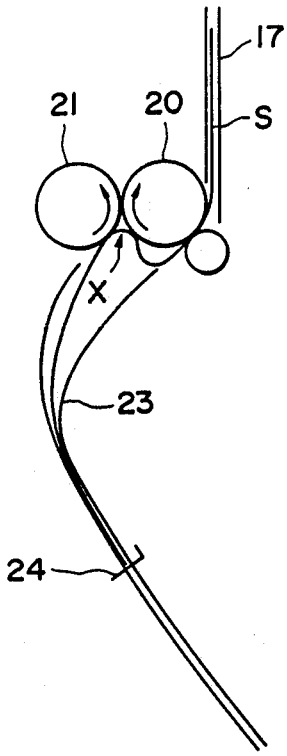
FIGS. 3A and 3B illustrate the process of folding the sheet by a couple of rollers.
Figure 3B:
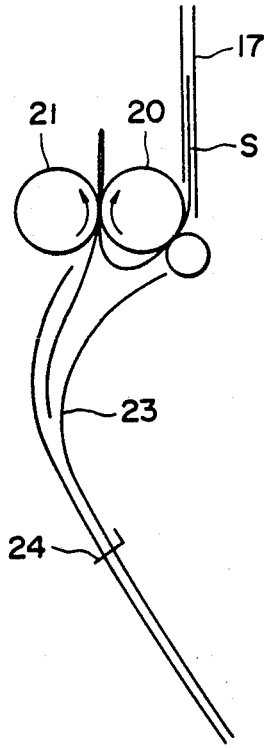
Figure 5A:
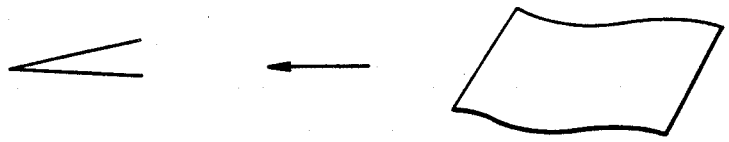
FIGS. 5A, 5B and 5C illustrates the manners of the two-folding, z-folding and a reversed z-folding.

As shown in FIG. 5A, when the two-folding mode is selected, the first deflector 22 selects the first folding position controlling passage 23, so that the sheet S is conveyed to the first folding position controlling passage 23 to such an extent that the leading edge of the sheet S abuts the fixed stopper 24. At this time, the solenoid 25*a* for driving the movable stopper 25 is not energized, and therefore, the movable stopper 25 is retracted from the folding position controlling passage 23. When the leading edge of the sheet S abuts the fixed stopper 24, a loop X is formed in the middle of the sheet S as shown in FIG. 3A. Then, the loop X of the sheet S is gripped by the nip of the first stage folding roller couple (20, 21) with the result that a fold is formed in the middle of the sheet S. The thus two-folded sheet S is guided by the second deflector 26 directed to the second stage folding roller couple (21, 29) and by the third deflector 31 directed to the third stage folding roller couple (29, 33), so that the sheet S is conveyed through the second stage folding roller couple (21, 29), the third stage folding roller couple (29, 33) and through the additional passage 36. Then, the sheet S is discharged through the outlet 3 by the rotation of the discharging roller couple 19.

Figure 5B:
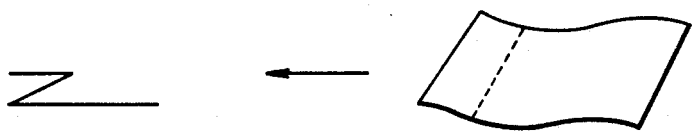

As shown in FIG. 5B, when the z-folding mode is selected, the first deflector 22 is switched to the first folding position controlling circuit 23, and the solenoid 25*a* is energized, and therefore, the movable stopper 25 is in the folding position controlling passage 23. The sheet S is guided by the first deflector 22 and is conveyed through the first folding position controlling passage 23 until the leading edge of the sheet S is stopped by the movable stopper 24. Then, a loop is formed adjacent a portion of one fourth of the length of the sheet S from the leading edge thereof. The loop of the sheet S thus formed is gripped by the first stage folding roller couple (20, 21), whereby a first fold is formed at a position of one fourth of the sheet S. The sheet S now having the first fold is guided by the second deflector 26 switched to the second folding position controlling passage 27 and is transported through the second folding position controlling passage 27 until the leading edge of the sheet S is stopped by the fixed stopper 30. Then, a loop is formed adjacent an end of the edge of the folded portion of the sheet S, and the thus formed loop is gripped by the nip of the second stage folding roller couple to form a second fold at this portion, so that a z-folded sheet is produced. Then, the sheet S is guided by the third deflector 31 switched to the third stage folding roller couple (29, 33), and is transported by the third stage folding roller couple (29, 33) and through the additional passage 36. Subsequently, it is discharged through the outlet 3 by the rotation of the discharging roller couple 19.

Figure 5C:
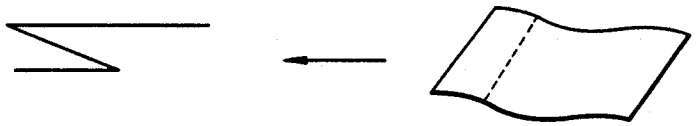

As shown in FIG. 5C, when the reversed z-folding mode is selected, the first deflector 22 selects the first stage folding roller couple (20, 21); the second deflector 26 selects the second folding position controlling circuit 27. Therefore, the sheet S is conveyed to the second folding position controlling passage 27 by the deflectors 22 and 26 and the first stage folding roller couple (20, 21), until the leading edge of the sheet S is stopped by the fixed stopper 30. Then, the sheet is further conveyed so that a loop is formed at a position adjacent to one fourth of the sheet S from the leading edge thereof. The loop of the sheet S is gripped by the nip of the second stage folding roller couple (21, 29), so that a first fold is formed at the position of one fourth of the sheet S. It should be noted that the direction of folding is opposite to the above-described case of the z-folding mode. The sheet S having the first fold is guided by the third deflector 31 switched to the third folding position controlling passage 32, and is conveyed to the third folding position controlling passage 32. The leading edge of the sheet S abuts the fixed stopper 35. When the sheet S is further conveyed, a loop is formed adjacent to the folded edge of the sheet S. The loop of the sheet S is gripped by the nip of the third stage folding roller couple (29, 33). Thus, the second fold is formed adjacent the first-folded edge of the sheet S. It should be noted that at the second fold, the sheet is folded in the opposite orientation to the case of the z-folding mode, thus providing a reversed z-folded sheet. The sheet S is transported through the additional passage 36 and is then discharged through the outlet 3 by rotation of the discharging roller couple 19.

The sheet S discharged through the outlet 3 of the folding apparatus 1 in the manners described above, is conveyed to the inlet deflector 43 from the inlet 9 by rotation of the receiving roller couple 42. When a stacking mode is selected wherein the sheet S is stacked on the sheet stacking tray 5*a*, the inlet deflector 43 selects the stacker passage 45, whereby the sheet S is transported therethrough and is discharged onto the tray 5*a* by rotation of the discharging roller couple 47. At this time, the sheet stacking tray 5*a* is moved in the horizontal direction, if necessary, so that the discharged sheets S are classified. The sheet stacking tray 5*a* is lowered in accordance with the amount of the stacked sheets S on the tray 5*a* so as to maintain a substantially constant and predetermined height through which the sheet S falls from the discharging roller couple 47 to the topmost sheet S on the stacking tray 5*a*.

When a stapling mode is selected wherein the sheets are stacked and stapled, the inlet deflector 43 is switched to the stapling passage 46, whereby the sheet is conveyed therethrough. The sheet S is discharged onto the intermediate tray 6*a* by the rotation of the discharging roller couple 49 and rotation of the belt 50. The sheet S thus discharged is moved by the bottom portion of the belt 50 so that the trailing edges of the sheets S are aligned along the stopper 40. When a predetermined number of the sheets S are stacked and aligned on the intermediate tray 6*a*, the end portions thereof are stapled by he stapler 51. The stopper 40 is then pivotted so as to allow the stapled sheets S to fall to the lower tray 41.

Figure 9:
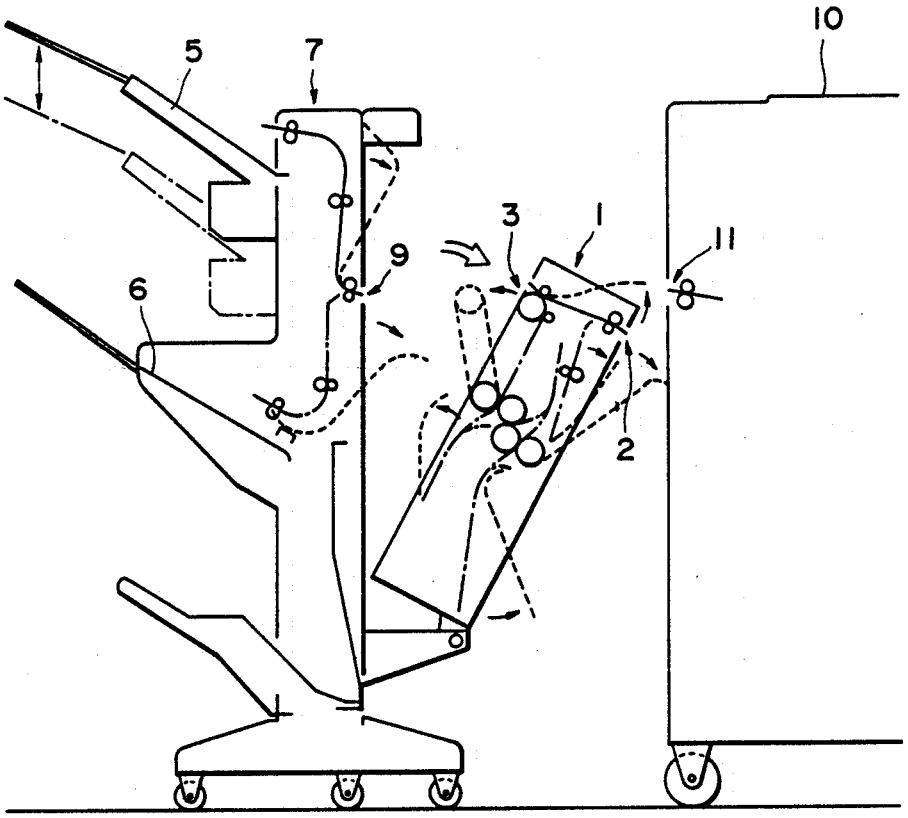
FIG. 9 illustrates a manner of jam disposal when the sheet folding apparatus is coupled to the image forming apparatus together with the finisher apparatus.

When the copying apparatus 10, the folding apparatus 1 and the finisher apparatus 7 are coupled in series as shown in FIG. 9, the finisher apparatus 7 and the folding apparatus 1 are separated from the copying apparatus 10 upon occurrence of jamming in the folding apparatus 1 or in the finisher apparatus 7. Further, the folding apparatus 1 is pivotted with respect to the finisher apparatus 7. And, various parts are opened to dispose of the jam in the folding apparatus 1 or the finisher apparatus 7.

Figure 10:
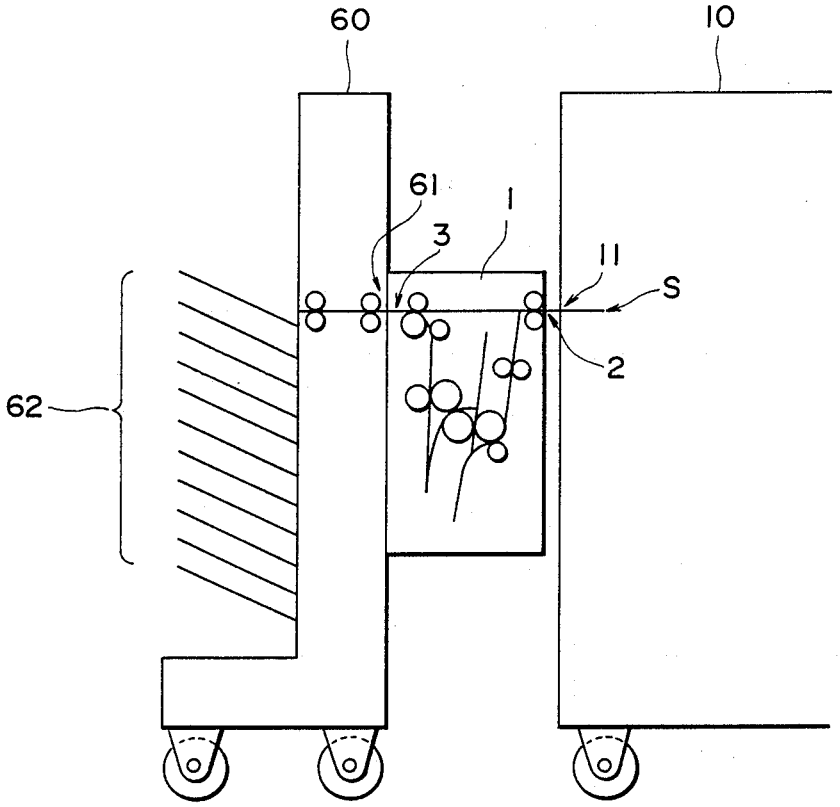
FIG. 10 is a sectional view of a sheet folding apparatus and a sorter apparatus which are coupled to the image forming apparatus.

FIG. 10 shows a second embodiment wherein a sorter apparatus 60 is coupled in place of the finisher apparatus 7 of FIG. 1. When a sorting mode is selected, a group of bin trays 62 is raised step-by-step from the state shown in the Figure and receives the sheets, so that the sheets received at the sheet inlet 61 is sorted.

As described in the foregoing, according to the first embodiment of the present invention, the sheet inlet 2 of the sheet folding apparatus 1 and the sheet discharging outlet 3 are aligned so that they are at substantially the same level, and the sheet inlet 9 of the finisher apparatus 7 constituted by a sheet stacking portion 5 for stacking the sheets S and a stapling portion 6 for stapling the sheets S are aligned so as to be at substantially the same level with the sheet discharging outlet 11 of the image forming apparatus 10, whereby the folding apparatus 1 and the finisher apparatus 7 are coupled with the image forming apparatus 10. When the sheet S discharged from the image forming apparatus 10 is not required to be folded, the finisher apparatus 7 can be directly coupled to the image forming apparatus 10. When only the folding operation is required, the folding apparatus 1 alone can be coupled to the image forming apparatus 10. Further, the structure is such that the folding apparatus can be coupled to the image forming apparatus 10, and that the finisher apparatus 7 can be coupled to the folding apparatus 1, and therefore, the sheets S discharged from the image forming apparatus 10 can be automatically folded, and further, the sheets can be stacked and sorted or stapled. For example, it is possible that a stack of A4 size sheets is accompanied by a z-folded sheet or sheets of A3 size are attached and stapled together with the stack, as is desirable in the case of a report document.

With the folding apparatus 1 and the finisher apparatus 7 connected to the image forming apparatus 10, when it is not required that the sheet S discharged from the image forming apparatus 10 is folded, and that only the processing by the finisher apparatus 7 is required, the sheet S passes through the folding apparatus 1 without being folded, so that it is possible that the sheet S is processed only by the finisher apparatus 7.

The same applies to the second embodiment, and it is not necessary to change the coupling or couplings between the post-processing apparatuses. It is still possible that one or both of the folding process and the sorting process can be effected as desired to the sheet.

According to the embodiment of FIG. 6 of the drawing, the sheet post-processing apparatus includes a stacking portion for stacking the sheets discharged from the image forming apparatus, the stacker portion including a tray substantially vertically movable in accordance with the height of the stack of sheets on the tray, a stapling portion for stapling the discharged sheets and a lower tray for receiving the stapled sheets which falls thereto. Because of this, the sheets discharged from the image forming apparatus can be automatically stacked or stapled by a single sheet post-processing apparatus. Thus, it is not necessary to couple a desired folding apparatus to the image forming apparatus depending on the kinds of processing.

While the invention has been described with reference to the structures disclosed herein, it is not confined to the details set forth and this application is intended to cover such modifications or changes as may come within the purposes of the improvements or the scope of the following claims.

What is claimed is:

1. A sheet processing apparatus, comprising:

an inlet adapted to receive sheets;

stacking means for stacking sheets received through said inlet;

a tray, disposed below said stacking means, for stacking sheets received through said inlet, said tray being inclined downwardly toward an upstream side with respect to movement of the sheets to said tray;

a stopper for stopping upstream edges of the sheets on said tray;

means for urging the sheets to said stopper to align the sheets;

a stapler for stapling the sheets aligned on said tray by said urging means;

releasing means for moving said stopper away from its operative position to allow the sheets to fall;

an accommodating means, disposed below said tray, for receiving and accommodating the sheets allowed to fall by said releasing means;

a first passage for guiding the sheets from said inlet to said stacking means;

a second passage for guiding the sheets from said inlet to said tray; and selector means for selectively directing the sheets to said first or second passage.

2. An apparatus according to claim 1, wherein said inlet is communicatable with a sheet outlet of an image forming machine to receive the sheets therefrom.

3. An apparatus according to claim 1, wherein said stacking means includes a stacking tray for stacking the sheets received through said inlet.

4. An apparatus according to claim 3, wherein said stacking tray of said stacking means is vertically movable.

5. An apparatus according to claim 1, wherein said urging means includes a rotatable belt contactable with the top surfaces of the sheets.

6. An apparatus according to claim 1, wherein said stapler staples the sheets adjacent the upstream edges thereof with respect to movement of the sheets to said tray.

7. A sheet processing apparatus, comprising:

means for receiving and folding a sheet having a first size into a folded sheet having a second size;

means for conveying an unfolded sheet having the second size and the sheet folded to the second size;

a tray for stacking the sheets conveyed by said conveying means; and stapling means for stapling the unfolded sheet and the sheet folded by said folding means.

8. An apparatus according to claim 7, further comprising stacking means for stacking the sheets, second conveying means for conveying the folded and unfolded sheets sheets to said stacking means, and selector means for selectively directing the sheets to said first or second conveying means.

9. An apparatus according to claim 7, wherein the folded sheets are stacked with their folded sides at one side of the tray.

10. An apparatus according to claim 9, wherein said stapling means staples the unfolded sides of the sheets.

11. An apparatus according to claim 7, further comprising a supporting means for supporting said folding means for movement away from said apparatus.

12. An apparatus according to claim 7, wherein the second size is a half of the first size.

13. A sheet processing apparatus usable with an image forming apparatus, comprising:

a sheet folding unit including sheet folding means for folding sheets and sheet discharging means for discharging the folded sheets;

a stapler unit including a tray for stacking the sheets discharged from said sheet folding unit and stapling means for stapling the sheets, wherein said stapler unit and said sheet folding unit are separable from each other; and a common support for rotatably supporting said sheet folding unit and for supporting said stapler unit, to detachably mount, as a unit, a combination of said sheet folding unit and said stapler unit.

14. An apparatus according to claim 13, wherein said stapler unit is directly connectable with the image forming apparatus to staple the sheets discharged from the image forming apparatus.

15. A sheet processing apparatus, comprising:

a sheet inlet adapted to receive sheets;

folding means for folding the sheets;

stacking means for stacking sheets received through said inlet;

conveying means for conveying the sheets to said stacking means;

a first passage for directing the sheets from said sheet inlet to said folding means;

a second passage for directing the sheets from said folding means to said conveying means;

a third passage for directing the sheets from said sheet inlet to said conveying means not through said folding means;

switching means for selectively directing the sheets received by said sheet inlet to said first passage or to said third passage; and stapling means for stapling the sheets stacked on said stacking means.

16. An apparatus according to claim 15, further comprising a folding position controlling passage for accommodating a predetermined length of the sheet conveyed through said first passage from its leading edge and for holding the leading edge thereof, wherein said folding means includes a pair of rollers for gripping therebetween a portion of the sheet, held at its leading edge by said folding position controlling passage, at a position other than its leading or trailing edge, and thereby folding the sheet thereat, and for conveying the folded sheet with its fold leading.

17. An apparatus according to claim 15, wherein said conveying means conveys the sheet with its fold leading.

18. An apparatus according to claim 17, further comprising means for limiting an upstream edge of the sheet stacked on said stacking means with respect to a conveyance direction by said conveying means, alignment means for aligning the sheets relative to said limiting means, wherein said stapling means is disposed adjacent to said limiting means to staple the sheets adjacent their edges near said limiting means.

19. An apparatus according to claim 18, further comprising an additional folding position controlling passage and an additional pair of sheet folding rollers to provide plural folds on the sheet.

20. A sheet processing apparatus, comprising:

an inlet adapted to receive sheets;

stacking means for stacking sheets received through said inlet;

a tray, disposed below said stacking means, for stacking sheets received through said inlet, said tray being inclined downwardly toward an upstream side with respect to movement of the sheets to said tray;

a stopper for stopping upstream edges of the sheets on said tray;

means for urging the sheets against said stopper to align the sheets;

a stapler for stapling the sheets aligned on said tray by said urging means;

releasing means for displacing said stopper from its operative position to its inoperative position to release stoppage of the sheet;

accommodating means, disposed below said tray, for receiving and accommodating the sheets released by said releasing means;

a first passage for guiding the sheets from said inlet to said stacking means;

a second passage for guiding the sheets from said inlet to said tray; and selector means for selectively directing the sheets to said first or second passage.

21. An apparatus according to claim 20, wherein said inlet is communicable with a sheet outlet of an image forming machine to receive the sheets therefrom.

22. An apparatus according to claim 20, wherein said stacking means includes a stacking tray for stacking the sheets received through said inlet.

23. An apparatus according to claim 20, wherein said urging means includes a rotatable belt contactable with the top surfaces of the sheets.

24. An apparatus according to claim 20, wherein said stapler staples the sheets adjacent the upstream edges thereof with respect to movement of the sheets to said tray.

25. An apparatus according to claim 20, wherein said accommodating means includes a tray.

26. A sheet processing apparatus, comprising:

an inlet adapted to receive sheets;

stacking means for stacking sheets received through said inlet;

a tray, disposed below said stacking means, for stacking sheets received through said inlet, said tray being inclined downwardly toward an upstream side with respect to movement of the sheets to said tray;

locking means for stopping upstream edges of the sheets on said tray;

means for urging the sheets to said locking means to align the sheets;

a stapler for stapling the sheets aligned on said tray by said urging means;

accommodating means, disposed below said tray, for receiving and accommodating the sheets stapled by said stapling means;

a first passage for guiding the sheets from said inlet to said stacking means;

a second passage for guiding the sheets from said inlet to said tray;

a third passage for directing the sheet from said tray to said accommodating means; and selector means for selectively directing the sheets to said first or second passage.

27. An apparatus according to claim 26, wherein said inlet is communicable with a sheet outlet of an image forming machine to receive the sheets therefrom.

28. An apparatus according to claim 26, wherein said stacking means includes a stacking tray for stacking the sheets received through said inlet;

29. An apparatus according to claim 28, wherein said urging means includes a rotatable belt contactable with the top surfaces of the sheets.

30. An apparatus according to claim 26, wherein said stapler staples the sheets adjacent the upstream edges thereof with respect to movement of the sheets to said tray.

31. An apparatus according to claim 26, wherein said accommodating means includes a tray.

32. A sheet processing apparatus, comprising:

an inlet adapted to receive sheets;

stacking means for stacking sheets received through said inlet;

a tray, disposed below said stacking means, for stacking sheets received through said inlet, said tray being inclined downwardly toward an upstream side with respect to movement of the sheets to said tray;

a stopper for stopping the sheets at a lower side of said inclined tray;

a stapler for stapling the sheets stopped on said tray by said stopper;

releasing means for displacing said stopper from its operative position to its inoperative position to release stoppage of the sheet;

accommodating means, disposed below said tray, for receiving and accommodating the sheets released by said releasing means;

a first passage for guiding the sheets from said inlet to said stacking means;

a second passage for guiding the sheets from said inlet to said tray;

selector means for selectively directing the sheets to said first or second passage; and a third passage for directing the sheets from the lower side of said tray to said accommodating means.

33. An apparatus according to claim 30, wherein said inlet is communicable with a sheet outlet of an image forming machine to receive the sheets therefrom.

34. An apparatus according to claim 33, wherein said stacking means includes a stacking tray for stacking the sheets received through said inlet.

35. An apparatus according to claim 33, wherein said stapler staples the sheets adjacent the lower edge of said tray.

36. An apparatus according to claim 33, wherein said accommodating means includes a tray.

* * * * *

UNITED STATES PATENT AND TRADEMARK OFFICE

CERTIFICATE OF CORRECTION

PATENT NO. : 4,917,364

DATED : April 17, 1990

INVENTOR(S) : NORIYOSHI IIDA, ET AL.

It is certified that error appears in the above-identified patent and that said Letters Patent is hereby corrected as shown below:

TITLE PAGE-

AT [57] ABSTRACT

Line 5, "aformationed" should read --aforementioned--.

COLUMN 1

Line 55, "illustrated" should read --illustrates--.

COLUMN 2

Line 26, " f" should read --of--.
Line 30, "two" should read --to--.

COLUMN 4

Line 57, "movable stopper 24." should read --movable stopper 25.--

COLUMN 6

Line 3, "he" should read --the--.
Line 21, "is" should read --are--.

COLUMN 7

Line 2, "falls" should read --fall--.

UNITED STATES PATENT AND TRADEMARK OFFICE

CERTIFICATE OF CORRECTION

PATENT NO. : 4,917,364

DATED : April 17, 1990

INVENTOR(S) : NORIYOSHI IIDA, ET AL.

It is certified that error appears in the above-identified patent and that said Letters Patent is hereby corrected as shown below:

COLUMN 8

Line 2, "sheets sheets" should read --sheets--.

COLUMN 10

Line 19, "inlet;" should read --inlet.--.
Line 56, "claim 30," should read --claim 32,--.
Line 59, "claim 33," should read --claim 32,--.
Line 62, "claim 33," should read --claim 32,--.
Line 65, "claim 33," should read --claim 32,--.

Signed and Sealed this

Twenty-third Day of July, 1991

*Attest:*

HARRY F. MANBECK, JR.

*Attesting Officer*

*Commissioner of Patents and Trademarks*